US009121569B2

(12) United States Patent
Kim et al.

(10) Patent No.: US 9,121,569 B2
(45) Date of Patent: Sep. 1, 2015

(54) LIGHTING APPARATUS HAVING A HOUSING TO ACCOMODATE A REMOVABLE DIFFUSER

(71) Applicants: Dongmin Kim, Seoul (KR); Myoungwoo Lee, Seoul (KR); Sori Park, Seoul (KR); Minkwang Lee, Seoul (KR); Daewoo Lee, Seoul (KR)

(72) Inventors: Dongmin Kim, Seoul (KR); Myoungwoo Lee, Seoul (KR); Sori Park, Seoul (KR); Minkwang Lee, Seoul (KR); Daewoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 180 days.

(21) Appl. No.: 13/733,520

(22) Filed: Jan. 3, 2013

(65) Prior Publication Data

US 2013/0242556 A1 Sep. 19, 2013

(30) Foreign Application Priority Data

Mar. 19, 2012 (KR) ..... 10-2012-0027516

(51) Int. Cl.

| | |
|---|---|
| ***F21V 17/00*** | (2006.01) |
| ***F21V 5/00*** | (2015.01) |
| ***F21V 13/04*** | (2006.01) |
| ***F21S 8/04*** | (2006.01) |
| ***F21V 17/10*** | (2006.01) |
| ***F21V 23/02*** | (2006.01) |
| *F21V 27/02* | (2006.01) |
| *F21V 7/00* | (2006.01) |
| *F21V 13/02* | (2006.01) |
| *F21V 19/00* | (2006.01) |
| *F21Y 101/02* | (2006.01) |
| *F21Y 105/00* | (2006.01) |

(52) U.S. Cl.

CPC ... *F21V 5/00* (2013.01); *F21S 8/04* (2013.01); *F21V 13/04* (2013.01); *F21V 17/104* (2013.01); *F21V 23/02* (2013.01); *F21V 7/0083* (2013.01); *F21V 13/02* (2013.01); *F21V 19/0045* (2013.01); *F21V 27/02* (2013.01); *F21Y 2101/02* (2013.01); *F21Y 2105/001* (2013.01)

(58) Field of Classification Search

CPC ..... F21S 8/04; F21S 8/028; F21S 8/026; F21V 17/10; F21V 7/104; F21V 19/0045

USPC ..... 362/217.01, 217.14, 217.15, 217.17, 362/235, 246, 217.05

See application file for complete search history.

(56) References Cited

U.S. PATENT DOCUMENTS

| | | | | |
|---|---|---|---|---|
| 7,244,058 | B2 * | 7/2007 | DiPenti et al. | 362/547 |
| 2009/0219713 | A1 * | 9/2009 | Siemiet et al. | 362/218 |

(Continued)

FOREIGN PATENT DOCUMENTS

| | | | |
|---|---|---|---|
| JP | 2011-044428 | A | 3/2011 |
| JP | 2011-119206 | A | 6/2011 |
| KR | 10-2010-0020244 | A | 2/2010 |

(Continued)

*Primary Examiner* — Karabi Guharay

(74) *Attorney, Agent, or Firm* — KED & Associates, LLP

(57) ABSTRACT

Provided is a lighting apparatus that includes a housing having a bottom surface, a first side surface that extends from the bottom surface and a second side surface that extends from the bottom surface and positioned to face the first side surface. A substrate having a plurality of LEDs may be provided. A diffuser may be removably coupled to the housing and positioned over the substrate. An electronic module may be provided in the housing. The housing may include a first channel formed on the first side surface of the housing and a second channel formed on the second side surface of the housing. The first and second channels may be positioned to face each other to accommodate the diffuser. Moreover, at least one opening may be formed at the first and second channels for slidably inserting the diffuser in the first and second channels.

17 Claims, 6 Drawing Sheets

(56) References Cited

U.S. PATENT DOCUMENTS

| | | | | |
|---|---|---|---|---|
| 2010/0295468 | A1* | 11/2010 | Pedersen et al. | 315/294 |
| 2012/0127706 | A1* | 5/2012 | Jiang et al. | 362/218 |

FOREIGN PATENT DOCUMENTS

| | | | |
|---|---|---|---|
| KR | 10-1034465 | B1 | 5/2011 |
| KR | 10-1151823 | B1 | 5/2012 |

* cited by examiner

LIGHTING APPARATUS HAVING A HOUSING TO ACCOMODATE A REMOVABLE DIFFUSER

CROSS-REFERENCE TO RELATED APPLICATION(S)

This application claims the benefit of the Patent Korean Application No. 10-2012-0027516, filed on Mar. 19, 2012, which is hereby incorporated by reference as if fully set forth herein.

BACKGROUND

1. Field

A housing, a removable diffuser, and a lighting apparatus having the same are disclosed herein.

2. Background

Lighting apparatuses are known. However, they suffer from various disadvantages.

BRIEF DESCRIPTION OF THE DRAWINGS

The embodiments will be described in detail with reference to the following drawings in which like reference numerals refer to like elements, wherein.

DETAILED DESCRIPTION

Figure 1:
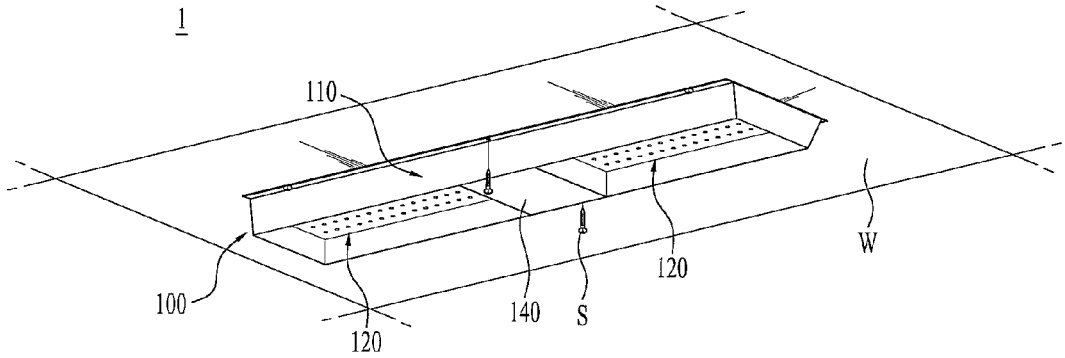
FIG. 1 is a perspective view illustrating an installation of a lighting apparatus according to an embodiment of the disclosure as broadly described herein.

A lighting apparatus according to embodiments of the present disclosure will be described in detail with reference to the accompanying drawings as follows. The accompanying drawings illustrate examples of the present disclosure and they are provided to facilitate a detailed description of various features, however, the present disclosure is not limited thereto.

Wherever possible, the same reference numbers will be used throughout the drawings to refer to the same or like parts.

Repeated description will be omitted and the size and appearance of each part illustrated for explanation convenience may be exaggerated or minimized.

Meanwhile, terminology including ordinal numbers like 'first' and 'second' may be used to explain various parts of the present disclosure and the various parts are not limited by the terminology. The terminology is used only to distinguish one of the parts from the others.

Generally, a light emitting diode (hereinafter, LED) is a semiconductor element which emits light when a forward voltage is applied thereto forwardly. Such a light emitting diode has a relatively longer life span and lower power consumption. In addition, the light emitting diode has electrical and optical and physical characteristics which may be suitable for and facilitate mass production. LED lighting systems may be installed in large buildings to light various rooms. LED lighting systems may be installed on the ceiling of a room at predetermined intervals. For example, an LED lighting apparatus may be a flat illumination type installed and fixed to a ceiling to light a large space such as an office.

Such a flat illumination type LED lighting apparatus may include a flat housing which defines an exterior appearance thereof, a LED light source arranged in the housing and an electronic module (for example, a converter) to supply electric power to the LED light source. The electronic module may be coupled to an outer portion of the housing while a plurality of LED light sources are arranged in the housing. That is, in many applications, only the LED light sources are housed inside the housing while other components are provided outside the housing.

Accordingly, when such an LED lighting apparatus is installed to the ceiling, a recess is provided in a predetermined area of the ceiling where the electronic module will be positioned. The electronic module of the conventional flat illumination type LED lighting apparatus is arranged in such a recess of the ceiling and covered by the housing such that the electric module are covered from view and not externally exposed. Hence, the conventional flat illumination type LED lighting apparatus may have a complex structure that prevents a user from having easy access thereto.

As a result, locations where such lighting apparatuses can be installed may be limited because a recess must be formed in the ceiling or wall to install the LED lighting apparatus thereto. If the electronic module needs replacing or repair, the conventional LED lighting apparatus must first be uninstalled from the ceiling leading to inefficiency and inconvenience. For example, if the electronic module is out of order, it might be difficult to replace only the electronic module. In this case, a new lighting apparatus may need to be installed rather than performing costly repairs. In addition, if each of the component parts composing the LED lighting apparatus needs replacing or repairing such as a substrate, or the like, the entire housing may require disassembly from the LED lighting apparatus. Accordingly, a lighting apparatus as broadly described and embodied hereinafter obviates these and other disadvantages.

Figure 2:
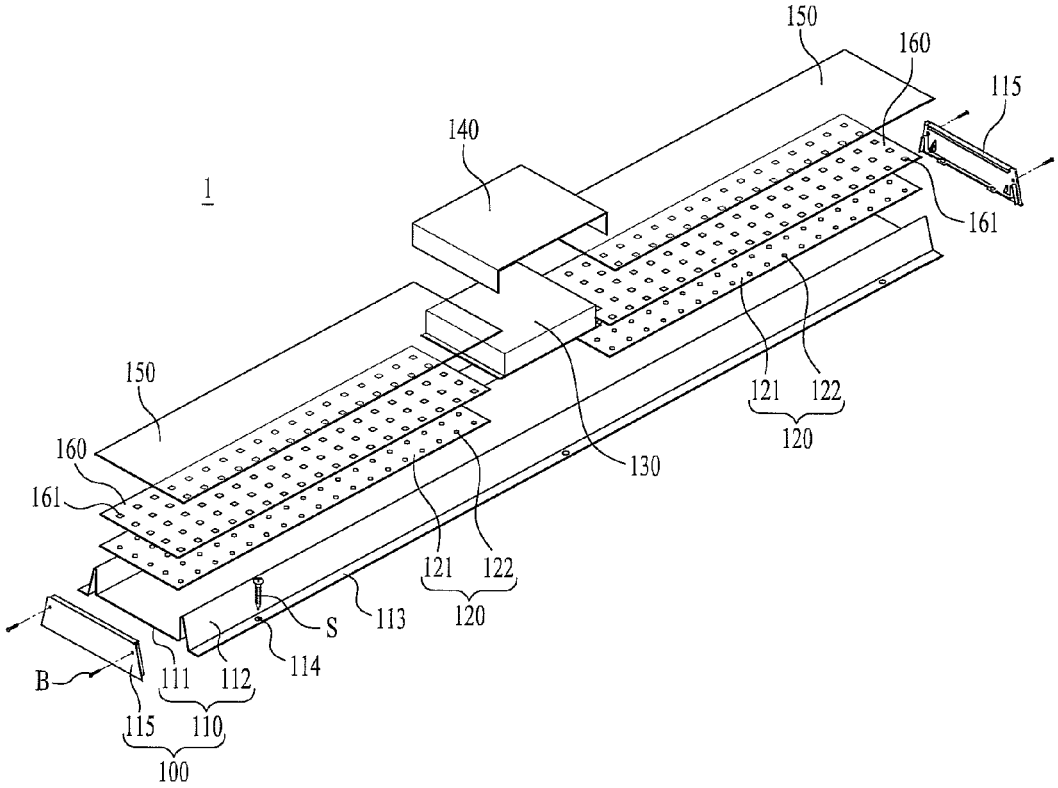
FIG. 2 is an exploded perspective view of the lighting apparatus according to one embodiment as broadly described herein.
Figure 3:
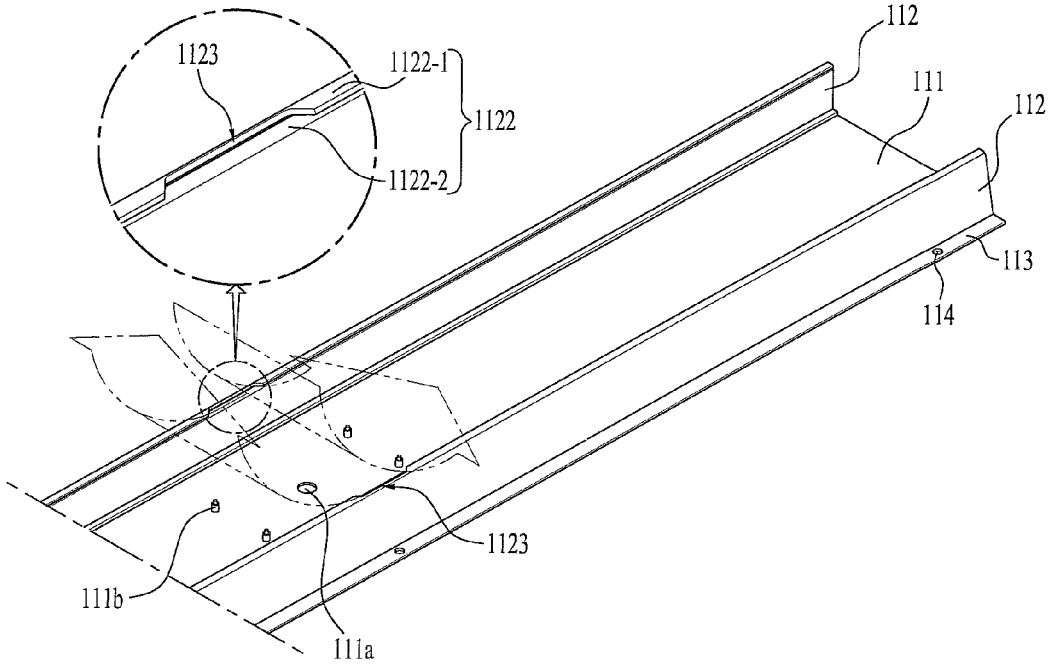
FIG. 3 is a partial perspective view of a housing of the lighting apparatus according to one embodiment as broadly described herein.

FIG. 1 is a perspective view illustrating an installation state of a lighting apparatus and FIG. 2 is an exploded perspective view of the lighting apparatus according to one embodiment as broadly described herein. FIG. 3 is a partial perspective view of a housing of the lighting apparatus according to one embodiment as broadly described herein.

The lighting apparatus 1 may include a housing 100, a light emitting device 120, an electronic module 130, a cover 140, a diffuser 150 and a reflector 160. In one embodiment, the housing 100 may have a bottom surface 111 and side surfaces 112 having a coupling device 1122 provided thereon, a light emitting device 120 having a substrate 121 arranged on the bottom surface 111 of the housing 100 and a plurality of LEDs 122 mounted on the substrate 121, and a diffuser 150 detachably coupled to the coupling device 1122. In this instance, an introducing region or opening 1123 (also, 1123-1, see FIG. 7) may be provided in the housing 100 to enable the diffuser 150 to be inserted in and withdrawn from the coupling device 1122.

The coupling device 1122 may be a slide rail or channel that extends along a longitudinal direction on the side surface 112 of the housing 100. The slide rail 1122 may include an outer support surface 1122-1 that supports an outer surface (e.g., top surface) of the diffuser 150 and an inner support surface 1122-2 to support an inner surface of the diffuser 150. Also, the introducing region 1123 may be an opening formed at a predetermined region of the outer support surface 1122-1.

The lighting apparatus 1 may further include the electronic module 130 arranged in a central region of the housing 100 to supply electric power to the light emitting device 120. The opening 1123 may be provided in the central region of the housing 100. Light emitting device 120 may be arranged adjacent to the electronic module 130, for example, at both sides of the electronic module 130. The diffuser 150 may be arranged to correspond to the positions of each light emitting device 120.

A coupling device 111*b* may protrude from the bottom surface 111 of the housing 100 to couple the electronic module 130 to the housing 100. The electronic module 130 may be coupled to the housing 100, spaced apart a predetermined distance from the bottom surface 111. The coupling device 111*b* may be a spacer, stud, or the like.

Also, a through-hole 111*a* may be provided on the bottom surface 111 and a cable C (FIG. 5) may be drawn outside the housing 100 via through-hole 111*a*. Here, a predetermined space may be formed between the bottom surface 111 and the electronic module 130.

The cover 140 may be provided to cover the opening 1123 and the electronic module 130. The cover 140 may be detachably coupled to the housing 100. A plurality of coupling ribs 141 may be provided on the cover 140. The plurality of ribs 141 may be detachably coupled to the slide rail 1122. The cover 140 may be formed of a transparent material and the electronic module 130 may be visible through the transparent cover 140.

In one embodiment, the introducing region 1123 may be an inserting slot 1123-1 formed on the side surface 112 of the housing 100. The inserting slot 1123-1 may be positioned to communicate with the coupling device 1122. Here, the diffuser 150 may be laterally installed into the coupling device 1122 using the inserting slot 1123-1.

In one embodiment, the housing 100 may include a channel 110 having the bottom surface 111 and a plurality of side surfaces 112. A coupling device 1122 may be provided in the channel 110. The housing 100 may also include a side cover 115 coupled to each of the open ends of the channel 110. Light emitting devices 120 may be arranged in the housing 100. The light emitting device 120 may include a substrate 121 and a plurality of LEDs 122 mounted on the substrate 121. A reflector 160 may be provided over the light emitting device 120. The reflector 160 may include a plurality of holes 161 positioned to correspond to a position of the LEDs 122. The holes 161 may also be shaped to correspond to the shape of the LEDs 122. The holes 161 allow the LEDs 122 to be exposed through the reflector 160.

One or more diffusers 150 may be detachably coupled to the coupling device 1122. Moreover, an electronic module 130 may be arranged in the channel 110, between the light emitting devices 120, to supply electric power to the light emitting devices 120. In this instance, an opening 1123 (or slot 1123-1) may be provided in the channel 110 to enable the diffuser 150 to be inserted or removed.

In the present disclosure, the housing 100 may refer to only the channel 110 or both of the channel 110 and the side cover 115. Moreover, the channel 110 and the side cover 115 may be separate components which are assembled together or they may be integrally formed as one body.

Each of the component parts of the lighting apparatus 1 will be described in detail in reference to the accompanying drawings.

Referring to FIG. 2, the housing 100 may define an exterior appearance of the lighting apparatus 1. The housing 100 may include the channel 110 and the side cover 115. The channel 110 may include the bottom surface 111 and two side surfaces 112 that face each other. The side surfaces 112 may be parallel to each other or formed at a prescribed angle relative to the bottom surface 111. The side cover 115 may be coupled to an open end of the channel 110. The side cover 115 may be provided on both open ends of the channel 110. The channel 110 may have, for example, a U-shaped cross-section, such that the channel 110 is open at the front (light emitting side) and the two distal ends.

The channel 110 may be formed of a metal or resin having high durability and rigidity. According to an embodiment, the channel 110 may be formed of a resin allowing the lighting apparatus 1 to have a compact size and lower weight. To reinforce the rigidity of the channel 110, a reinforcing member 180 formed of metal may be coupled to the bottom surface 111 of the channel 110. The reinforcing member 180 may be insert-molded. It should be appreciated that the reinforcing member 180 may be provided regardless of the material of the channel 110 based on need to reinforce strength of the housing 100.

The cover 140 may be positioned in a predetermined portion of the open front (light emitting side) formed in the channel 110 and the diffuser 150 may be positioned in the remaining regions of the open front. The side cover 115 may be coupled to each of the open sides formed in the channel 110.

The channel 110, the diffuser 150, the cover 140 and the side cover 115 may define the exterior appearance of the lighting apparatus 1. After being installed to the ceiling, for example, the diffuser 150 and the cover 140 may define a front profile of the lighting apparatus 1. The side cover 115 and the side surfaces 112 of the channel 110 may define a side profile of the lighting apparatus 1. The bottom surface of the channel 110 may define a bottom profile of the lighting apparatus 1.

Also, the cover 140 and the diffuser 150 may be positioned to be partially overlapped with each other or not overlapped at all. The channel 110 and the side cover 115 may be integrally formed with each other or they may be independent members. When they are independently provided, the channel 110 and the side cover 115 may be fitted to each other by fastening means (B) such as a screw, bolt, or the like. Moreover, the fastening means may be formed integrally on either the side cover 115 or the channel 110. For example, the fastening means (B) may be hooks, tabs, or the like that allow the side cover 115 to be attached to the channel 110.

The housing 100 may include a plurality of flanges 113. For example, the bottom surface 111 of the channel 110 may face the wall (W) after installation. Also, a plurality of flanges 113 may be provided in the channel 110 and a plurality of fastening holes 114 may be formed in the flanges 113 to fasten the flanges to the wall (W). The flange 113 may protrude from the side surface 112 of the channel 110, for example, laterally away from the side surface 112. The flange 113 may have a bar shape that extends along a longitudinal direction of the channel 110. Moreover, rather than a single flange 112 that extends the length of the channel 111, a plurality of shorter flanges 113 may be provide along the length of the channel 110.

The flange 113 may be positioned in the bottom surface 111 of the channel 110. The flange 113 may be positioned adjacent to the bottom surface 111 of the channel 110 to form a flat surface with the bottom surface 111 of the channel 110 or projected toward the wall (W) from the bottom surface 111. This structure may enable the bottom surface 111 of the channel 110 to be positioned closer to the wall (W) when installed. Accordingly, the thickness of the lighting apparatus 1 exposed outside the wall (W) may be reduced to provide a lower profile.

A plurality of fastening members (S) may be placed through the fastening hole 114 of the flange 113 to secure the lighting apparatus 1 to the wall (W). The electronic module 130 may be arranged in the housing 100 of the lighting apparatus 1. Accordingly, when the lighting apparatus 1 is installed on the wall (W), an auxiliary recess that receives the electronic module 130 may not be necessary. Hence, the overall installation process may be simplified and the production cost may be lowered.

As mentioned above, the diffuser 150 and the cover 140 may define the front profile (light emitting side) of the lighting apparatus 1. According to an embodiment, when the cover 140 is separated from the housing 100, the diffuser 150 and the electronic module 130 may be exposed. For replacement and repair, the electronic module 130 and the diffuser 150 may be easily removed from the lighting apparatus 1 without uninstalling additional components.

When the diffuser 150 is separated, the light emitting device 120 may be separated from the housing 100. After the cover 140 is separated, all of the component parts of the lighting apparatus 1 may be separated from the housing 100. Accordingly, the lighting apparatus 1 as broadly described herein may enable a more convenient process for replacement and repair.

The cover 140 may be detachably coupled to the housing 100. For example, the cover 140 may be detachably coupled to the channel 110. Moreover, the electronic module 130 may be detachably coupled to the housing 100. For example, the electronic module 130 may be detachably coupled to the channel 110. When the cover 140 is separated from the channel 110, the electronic module 130 may be removed without uninstalling the lighting apparatus 1. For example, various components such as the electric module 130 or the light emitting device 120 may be accessed without lowering the lighting apparatus 1 from the ceiling.

Figure 4:
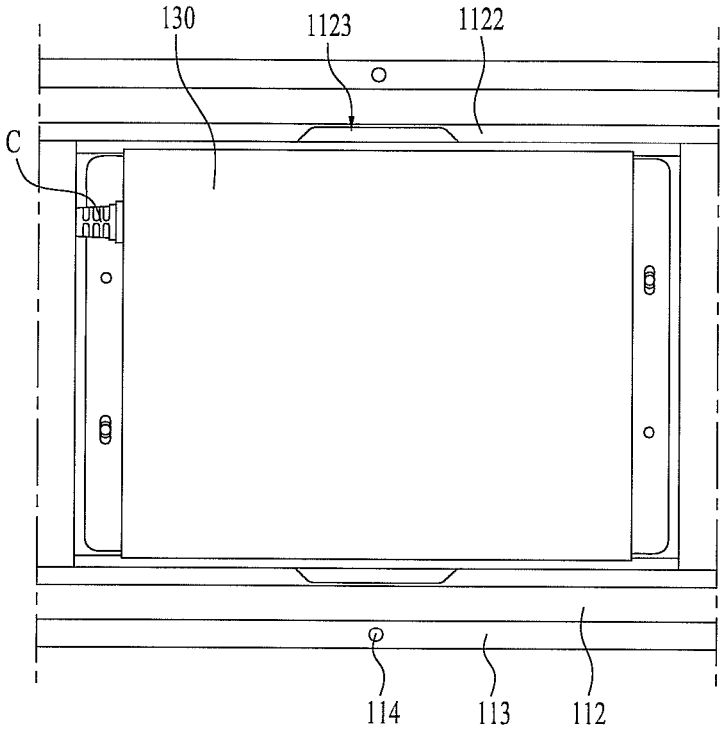
FIG. 4 is a plan view illustrating a state in which a cover is removed from the lighting apparatus according to one embodiment of the disclosure as broadly described herein.

FIG. 4 is a plan view illustrating a state in which a cover is removed from the lighting apparatus according to one embodiment of the disclosure as broadly described herein. The electronic module 130 may be detachably coupled to the housing 110 and 115, specifically, the electronic module 130 may be detachably coupled to the channel 110. When the cover member is separated from the channel 110, the electronic module 130 may be detachable outside and this will be described in detail later.

In reference to FIGS. 3 and 4, the channel 110 may have a slide rail 1122 and an opening 1123 (also referred to herein as an introduction region) formed in a predetermined portion of the slide rail 1122. The slide rail 1122 may be a channel. The diffuser 150 may be coupled to the slide rail 1122 of the channel 110 by sliding in and out via the opening 1123. The slide rail 1122 may be formed on one or more of the side surfaces 112 of the channel 110 to stably guide the sliding movement of the diffuser 150.

Figure 5:
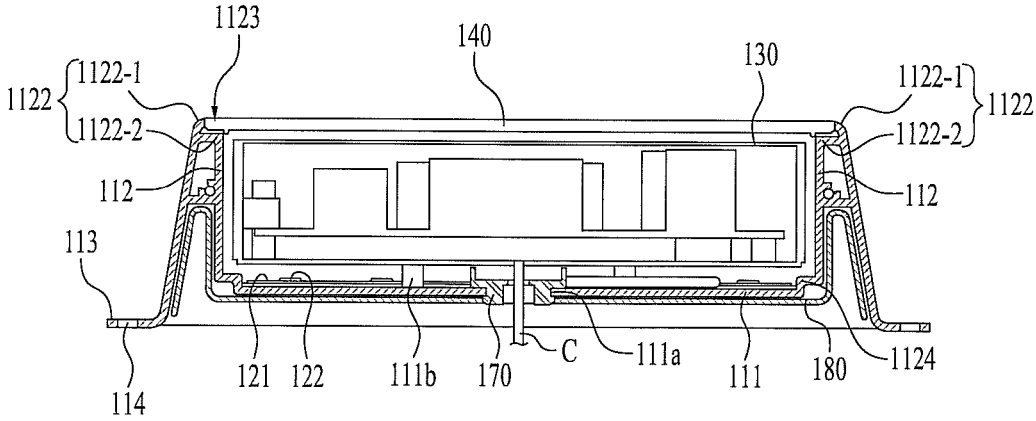
FIGS. 5 to 6 are sectional views of the lighting apparatus according to one embodiment of the disclosure as broadly described herein.
Figure 6:
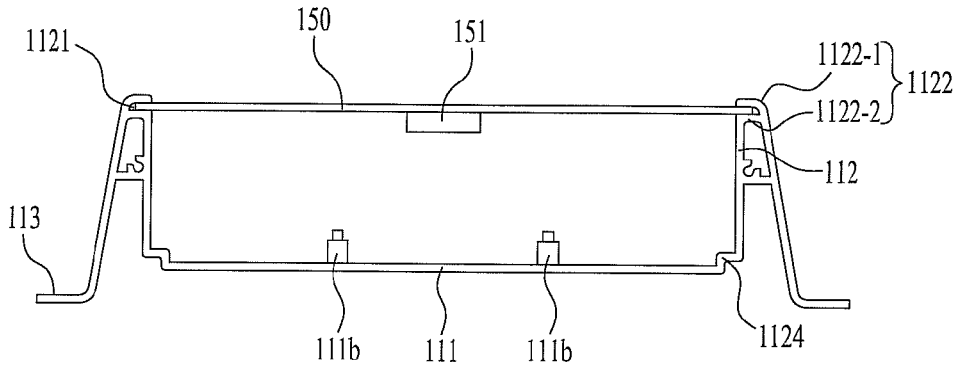

FIGS. 5 and 6 are sectional views of the lighting apparatus according to one embodiment of the disclosure as broadly described herein. In reference to FIGS. 3 and 5, the slide rail 1122 may have a structure that is able to support at least one of the top or bottom surfaces of both lateral sides of the diffuser 150. The slide rail 1122 may include a first region 1122-1 corresponding to a top surface (outer surface) of the diffuser 150 and a second region 1122-2 corresponding to a bottom surface (inner surface) the diffuser 150. The opening 1123 may be provided in the first region 1122-1 of the slide rail 1122. The opening 1123 and the first region 1122-1 may be substantially parallel to the bottom surface of the housing 100. The diffuser 150 may be inserted and withdrawn from the slide rail 1122 via the opening 1123.

The opening 1123 may have prescribed dimensions to allow the diffuser 150 to easily be inserted into the slide rail 1122. For example, the width of the opening 1123 may be the same as the width of the first region 1122-1 (outer surface) and the length of the opening 1123 may be based on the flexibility of the diffuser 150. Moreover, the opening 1123 may be formed to ensure that it can accommodate the width of the diffuser 150.

In reference to FIG. 6, the slide rail 1122 may be a recess 1121 formed in the side surface 112 of the channel 110 to receive the diffuser 150 therein. In one embodiment, the slide rail 1122 may be formed using bars that protrude from the side surface 112. Here, the slide rail 1122 may include a first projected bar inwardly projected into the channel 110 from the side surface 112 of the channel 110 and a second projected bar inwardly projected from the side surface 112 of the channel 110. The first projected bar may correspond to the top surface (outer surface) of the diffuser edge and the second projected bar may correspond to the bottom surface (inner surface) of one of the diffuser edge.

While the recess type slide rail 1122 provided in the side surface 112 of the channel 110 and the bar type slide rail 1122 having the recess formed between the two projected bars are disclosed herein, the embodiments of the disclosure are not limited thereto. The slide rail 1122 may have various structures and appearances capable of supporting at least one of the top and bottom surfaces along a length of each side of the diffuser 150.

In reference to FIG. 6, a handle 151 may be provided in the diffuser 150 and the handle 151 may be a projection provided in a predetermined portion of the diffuser 150 corresponding to the opening 1123 of the slide rail 1122. Accordingly, after detaching the cover 140 from the channel 110, a user may grasp the handle 151 to conveniently withdraw the diffuser 150 out from the housing 100. The handle 151 may be a variety of types including, for example, the projected handle, a recessed handle, a textured surface on the diffuser 150, or another appropriate type of structure to enable a firm grasp of the diffuser 150.

Figure 7:
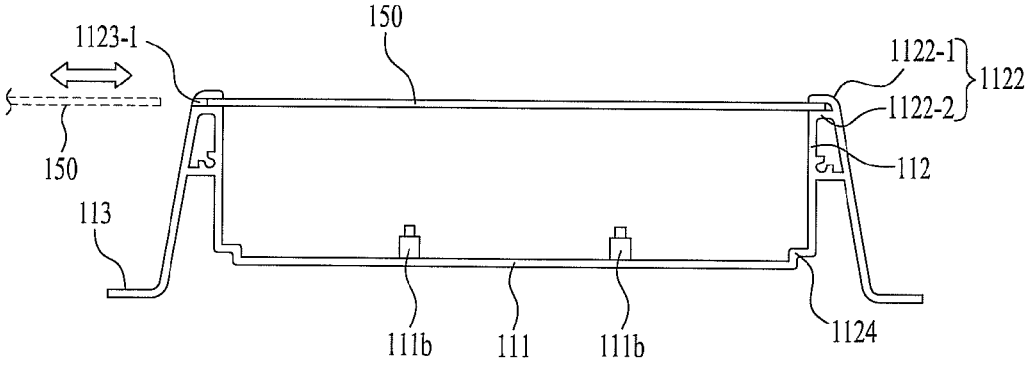
FIG. 7 is a sectional view of a lighting apparatus according to one embodiment of the disclosure as broadly described herein.

FIG. 7 is a sectional view of a lighting apparatus according to one embodiment as broadly described herein. Here, an inserting slot 1123-1 (also referred to as an opening) may be provided in the side surface 112 of the channel 110 to insert and withdraw the diffuser 150 laterally from the side of the housing 100. As mentioned above, when the insertion slot 1123-1 is provided in the side surface 112 at the slide rail 1122, the diffuser 150 may be inserted or withdrawn laterally via the side surface 112 of the channel 110. An auxiliary packing member may be coupled to the inserting slot 1123-1 to cover the opening. The inserting slot 1123-1 may be provided in lieu of the opening 1123 or the inserting slot 1123-1 and opening 1123 may both be provided.

Figure 8:
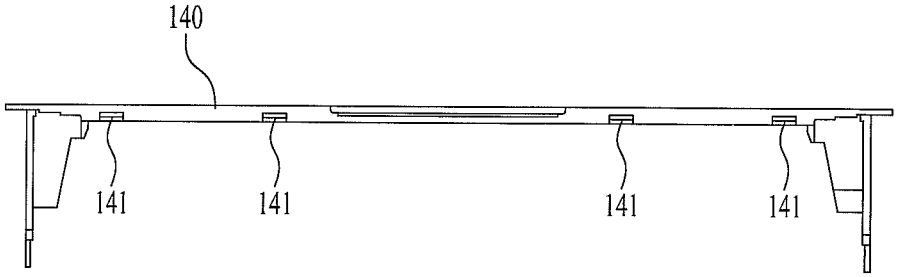
FIG. 8 is a side view of the cover of the lighting apparatus according to one embodiment of the disclosure as broadly described herein.

FIG. 8 is a side view of the cover of the lighting apparatus according to one embodiment of the disclosure as broadly described herein. The cover 140 may be coupled to the channel 110 to cover the opening 1123 of the slide rail 1122 and the electronic module 130. The cover 140 may be detachably coupled to the channel 110. For that, a plurality of coupling ribs 141 may be provided on the cover 140 for detachably coupling to the slide rail 1122. The coupling ribs 141 may have an inclined surface formed in a predetermined portion thereof, corresponding to the slide rail 1122. The inclined surface of the coupling ribs 141 may allow the cover 140 to easily be snapped into place.

Meanwhile, a coupling device 111*b* may be provided to protrude from the bottom surface 111 of the channel 110 to couple the electronic module 130 securely. The electronic module 130 may be spaced apart a predetermined distance from the bottom surface 111 of the channel 110. When the electronic module 130 is mounted, a gap may be formed between the electronic module 130 and the bottom surface 111.

For example, a plurality of coupling devices 111*b* may be provided in the bottom surface 111 of the channel 110. The coupling device 111*b* may be a spacer, stud, or the like. The coupling device 111*b* may allow the electronic module 130 to be spaced apart a predetermined distance from the bottom surface 111 of the channel 110 to provide a predetermined amount of space between the electronic module 130 and the bottom surface 111 of the channel 110.

Referring again to FIG. 5, a through-hole 111*a* may be provided in the bottom surface 111 of the channel 110. The cable (C) for connecting the electronic module 130 to an external electric power source may be withdrawn outside via the through-hole 111*a* and the space formed between the bottom surface 111 and the electronic module 130.

The through-hole 111*a* may be formed in the area that overlaps the electronic module 130. This configuration may enhance spatial utilization to enhance a luminous area of the lighting apparatus 1 by, for example, allowing for optimal number and positions of the LEDs.

The lighting apparatus 1 may further include a packing member 170 coupled to the through-hole 111*a* and the cable (C) may be withdrawn outside via the packing member 170. The packing member 170 may be a gasket or grommet and may be formed of rubber, silicon, or the like. The packing member 170 may be employed to provide a seal which prevents foreign matter from entering the lighting apparatus 1.

The electronic module 130 may be detachably coupled to the coupling device 111*b* of the channel 110. Various types of connectors may be used to couple the electronic module 130 to the coupling device 111*b*. For example, a hook or the like may be provided to hook the electronic module 130 to the coupling device 111*b*. The electronic module 130 may also be friction fitted to the coupling device 111*b*. In these examples, the electronic module 130 may be separated from the coupling device 111*b* by a predetermined amount of force applied to the electronic module 130 to be detached.

A fastening member such as a screw, bolt, or the like may also be provided to couple the electronic module 130 to the coupling device 111*b*. Here, the electronic module 130 may be detached from the coupling device 111*b* after the fastening member is separated when the electronic module 130.

Meanwhile, the electronic module 130, one or more light emitting devices 120 and the diffuser 150 may be arranged in the channel 110. In reference to FIG. 2, a plurality of light emitting devices 120 may be provided to satisfy a required amount of illuminance for the lighting space. According to an embodiment, the light emitting devices 120 may be arranged on the bottom surface 111 of the channel 110, on both sides of the electronic module 130.

At this time, the light emitting devices 120 may be in close contact with the bottom surface 111 of the channel to dissipate the heat generated during the operation of the light emitting devices 120 via the channel 110. According to an embodiment, the substrate 121 of the light emitting device 120 may be mounted on the bottom surface 111 of the channel 110.

Alternatively, the light emitting device 120 may be slidably coupled to the channel 110 to be inserted or withdrawn from the lighting apparatus. For that, a slide device 1124 may be provided in the channel 110 to guide the inserting and withdrawing of the light emitting device 120.

Especially, when the substrate 121 of the light emitting device 120 is a flexible circuit board, the cover 140 may be separated from the channel 110 and then the electronic module 130 may be separated from the coupling device 111*b*. After that, the light emitting device 120 may be withdrawn along the slide device 1124. The slide device 1124 may have various configurations to slidably guide the insertion of the light emitting device 120 as well as to provide support once installed. For example, the slide device 1124 may be angled corners formed on the housing as illustrated in FIGS. 5 to 7, a guide or slide rail, or a channel. Also, as mentioned above, a handle may be provided on the substrate 121 of the light emitting device 120, similar to the handle 151 provided on the diffuser 150.

Figure 9:
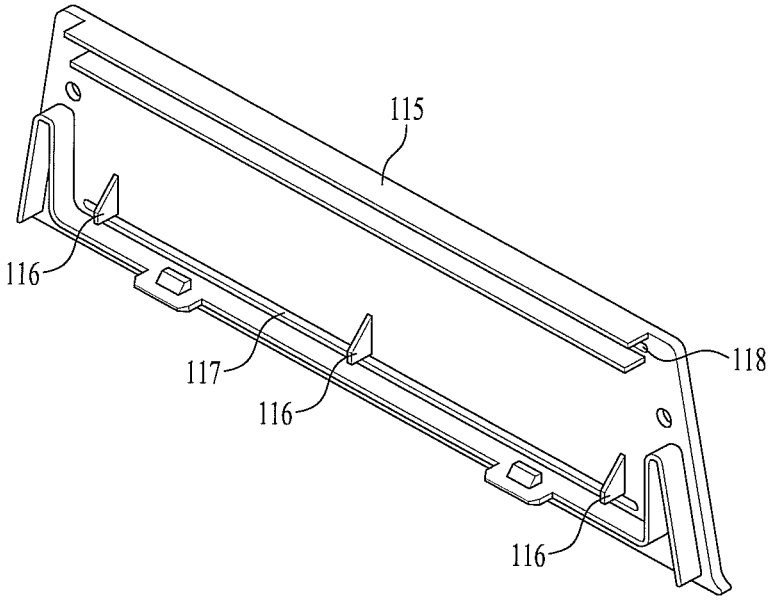
FIG. 9 is a perspective view of a side cover of the lighting apparatus according to one embodiment of the disclosure as broadly described herein.

FIG. 9 is a perspective view of a side cover of the lighting apparatus according to one embodiment of the disclosure as broadly described herein. A supporting rib 116 may be provided in the side cover 115 to support the light emitting device 120. The supporting rib 116 may be in contact with the substrate 121 of the light emitting device 120.

When the side cover 115 is coupled to the channel 110 in a state of mounting the light emitting device 120 to the bottom surface 111 of the channel 110, the supporting rib 116 of the side cover 115 may support the substrate 121 of the light emitting device 120.

Also, a slot 117 may be provided in the side cover 115 through which the light emitting device 120 may be withdrawn. In this structure, the light emitting device 120 can be withdrawn outside conveniently for replacement and repair, without requiring removal of the cover 140 and the electronic module 130. Moreover, the light emitting device 120 may be removed while the side cover 115 is coupled to the channel 110. A cap may be provided in the slot 117 to close or seal the slot 117 airtight when the light emitting device 120.

A through-hole 118 (also referred to herein as a slot) may be formed in the side cover 115 to enable the diffuser 150 to be inserted and withdrawn therethrough. In this structure, the diffuser 150 may be withdrawn outside conveniently for repair and replacement, without removing the electronic module 130, the cover 140 and/or the side cover 116.

Figure 10:
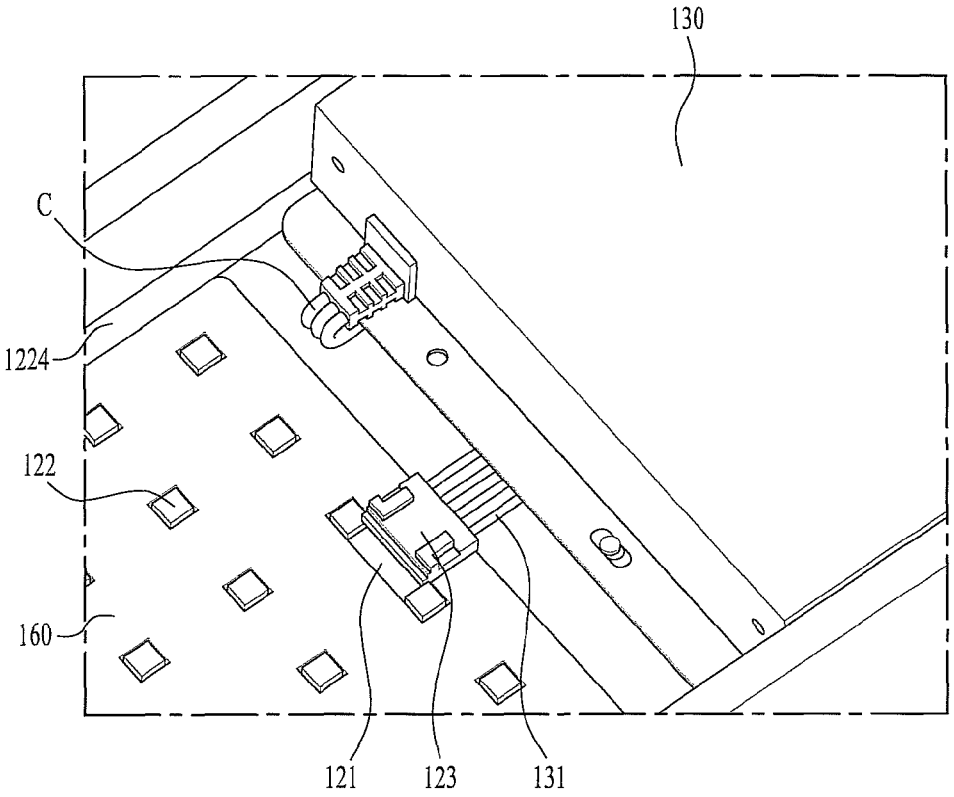
FIGS. 10 and 11 are cut-out perspective views illustrating various components of the lighting apparatus according to one embodiment of the disclosure as broadly described herein.
Figure 11:
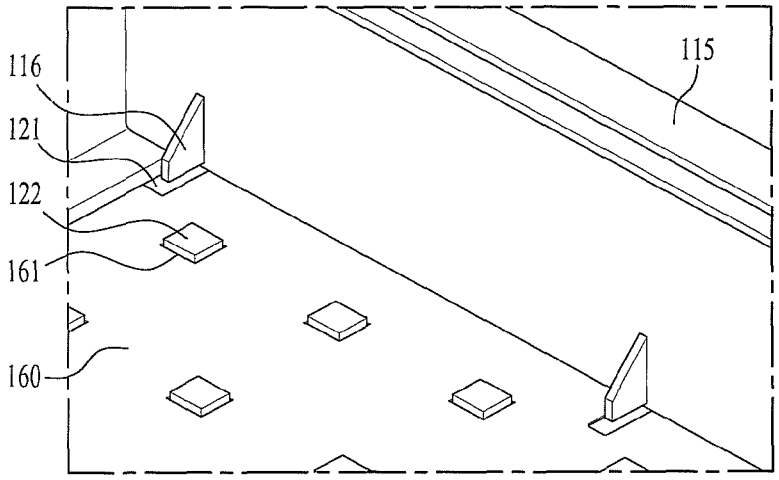

FIGS. 10 and 11 are cut-out perspective views illustrating various components of the lighting apparatus according to one embodiment of the disclosure as broadly described herein. In reference to FIG. 10, a first terminal 131 may be provided in the electronic module 130 for electrically connecting with the light emitting device 120 and a second terminal 123 may be provided in the light emitting device 120 for connection with the first terminal 131.

When the plurality of the light emitting devices 120 are provided in the channel 110, the second terminal 123 of the light emitting devices 120 that needs replacing or repairing may be disconnected from the first terminal 131 of the electronic module 130 and only the corresponding light emitting device 120 may be removed.

Also, the first terminal 131 of the electronic module 130 may be threaded toward the light emitting device 120 from a bottom surface of the electronic module 130 that faces the bottom surface 111 of the channel 110. In other words, the cable (C) and the first terminal 131 may be placed in the space formed between the electronic module 130 and the bottom surface of the channel 110, further enhancing the utilization of space.

Referring to FIG. 11, the lighting apparatus 1 may further include a reflector 160 provided in the light emitting device 120. The reflector 160 may be employed to reflect the light emitted from the LEDs 122 toward the diffuser 150. A plurality of holes 161 may be formed in the reflector 160 to correspond to the LEDs 122, and the reflector 160 may be attached to the substrate 122 in a state in which the LEDs 122 are exposed to the outside via the holes 161.

A method for disassembling each of the parts from the lighting apparatus 1 having the structure mentioned above is described hereinafter.

The cover 140 may be coupled to the slide rail 1122 of the channel 110 via the coupling rib 141. Accordingly, the cover member 140 may be pressed to detach the coupling rib 141 from the slide rail 1122 and the cover 140 may then be separated from the channel 110. When the cover 140 is separated, the diffuser 150 may be withdrawn outside via the opening 1123.

When the cover 140 is separated from the channel 110, the electronic module 130 may be exposed. Hence, the electronic module 130 which is detachably coupled to the coupling device 111*b* of the bottom surface 111 can be detached from the bottom surface 111 of the channel 110 conveniently.

As the electronic module 130 is electrically connected with the light emitting device 120, the first terminal 131 of the electronic module 130 may first be disconnected from the second terminal 123 of the light emitting nit 120 before detaching the electronic module 130.

The light emitting device 120 may be exposed when the diffuser 150 is detached. When the light emitting device 120 is coupled to the bottom surface 111 of the channel 110, the coupling state may be released before it is detached from the bottom surface 111. When the light emitting device 120 is coupled to the slide part 1124 of the channel 110, the light emitting device 120 may be laterally withdrawn outside along the slide part 1124. The light emitting device 120 may be withdrawn outside via the slot 117 of the side cover 115, without removal of the side cover 115.

As broadly described and embodied herein, a lighting apparatus is provided having improved appearance while facilitating convenient component replacement and maintenance, without being limited by an installation space. Moreover, a lighting apparatus is provided having a predetermined portion removably configured to allow access to an electronic module, a light emitting device and a diffuser for replacement or repair.

In one embodiment, a lighting apparatus may include a housing having a bottom surface, a first side surface that extends from the bottom surface and a second side surface that extends from the bottom surface and positioned to face the first side surface. The lighting apparatus may also include at least one substrate provided in the housing, a plurality of LEDs mounted on the substrate, at least one diffuser removably coupled to the housing and positioned over the at least one substrate, and an electronic module provided in the housing. The housing may include a first channel formed on the first side surface of the housing, a second channel formed on the second side surface of the housing, the first and second channels positioned to face each other to accommodate the diffuser, and at least one opening formed at the first and second channels for slidably inserting the diffuser in the first and second channels.

The first and second channels may extend along the housing in a longitudinal direction. The first and second channels may protrude laterally from the first and second surfaces toward each other. The opening may be formed on the first and second channels to be parallel to the bottom surface of the housing.

The first and second channels may include an outer surface and an inner surface that extend from the side surface of the housing substantially parallel to each other, wherein the outer surface is positioned adjacent to an outer surface of the diffuser and the inner surface is positioned adjacent to an inner surface of the diffuser. The inner and outer surfaces of the channels may be substantially parallel to the bottom surface of the housing, and wherein the opening is formed on the outer surface of the first and second channels.

The housing may include a side cover to enclose a longitudinal end of the housing, and wherein the opening is formed on the side cover and positioned to correspond to the first and second channels. The opening may be formed on the first or second side surface of the housing and positioned to correspond to the first and second channels. Moreover, the first and second channels may be recesses formed on respective side surfaces of the housing.

The electronic module may be disposed in a central region of the housing to supply power to the LEDs. The at least one substrate may be positioned adjacent to the electronic module, and the diffuser may be positioned over the substrate. Moreover, a coupling device may be provided to couple the electronic module to the housing. The coupling device may be formed to protrude a prescribed distance from the bottom surface of the housing such that a gap is formed between the electronic module and the bottom surface. A through-hole may be provided at the bottom surface, and a cable for connecting the electronic module to an external electric power source may be routed through the gap and the through-hole.

A cover may be provided that is removably coupled to the housing to cover the opening and the electronic module and positioned between the diffusers. The cover may include a plurality of coupling ribs to removably couple the cover to the housing. Moreover, the housing may include a guide rail formed on the side surface of the housing and configured to slidably guide the substrate into the housing. Moreover, the housing may include a plurality of flanges and a plurality of fastening holes formed on the flanges for mounting the housing. The plurality of the flanges may extend from the bottom surface of the housing. Moreover, a reflector may be provided between the light emitting device and the diffuser. The reflector may include a plurality of holes formed to correspond to a position of the plurality of the LEDs to expose the LEDs.

In one embodiment, a lighting apparatus may include a housing having a bottom surface, a first side surface that extends from the bottom surface and a second side surface that extends from the bottom surface and positioned opposite the first side surface, at least one substrate provided in the housing, a plurality of LEDs mounted on the substrate, a diffuser removably coupled to the housing and positioned over the substrate, and an electronic module provided in the housing, wherein the housing includes a first channel formed on the first side surface of the housing and a second channel formed on the second surface of the housing, the first and second channels positioned to face each other to accommodate the diffuser, and wherein the first and second channels include an opening formed on an outer surface of the channels such that the diffuser is slidably inserted in the first and second channels through the opening.

In one embodiment, a lighting apparatus may include a housing having a bottom surface and a plurality of side surfaces having a coupling part formed therein, a light emitting device comprising a substrate disposed in the housing and a plurality of LEDs mounted on the substrate, and a diffuser detachably coupled to the coupling part, wherein an introducing region is provided in the housing to insert and withdraw the diffuser therein and there from.

The coupling part may be a slide rail extended along a longitudinal direction of the side surface of the housing. The slide rail may include a supporting part to support an exposed surface of the diffuser and a separation preventing part to support a surface facing the exposed surface of the diffuser. The introducing region may be an opening formed in a predetermined portion of the supporting part.

The lighting apparatus may further include an electronic module disposed in a central region of the housing to supply an electric power to the light emitting device. The emitting units may be disposed at both sides of the electronic module, and the diffuser may be arranged in a position corresponding to each of the light emitting devices.

A coupling member may be projected from a bottom surface of a housing to couple the electronic module to the housing, and the electronic module may be spaced apart a predetermined distance from the bottom surface. A through-hole may be provided in the bottom surface, and a cable for connecting the electronic module to an external electric power may be withdrawn outside via the space formed between the bottom surface and the electronic module and the through-hole. The lighting apparatus may further include a packing member coupled to the through-hole, wherein the cable may be withdrawn via the packing member.

A first terminal may be provided in the electronic module to connect the electronic module to the light emitting device, and a second terminal may be provided in the light emitting device to be connected with the first terminal. The first terminal may be withdrawn toward the light emitting device from a bottom surface of the electronic module that faces the bottom surface of the housing.

The lighting apparatus may further include a cover member detachably coupled to the housing to cover the opening and the electronic module. A plurality of coupling ribs may be provided in the cover member to be detachably coupled to the slide rail. The cover member may be formed of a transparent material. Moreover, the introducing region may be an inserting slot formed in a side surface of the housing, and the inserting slot may be connected with the coupling part.

In one embodiment, a lighting apparatus may include a housing comprising a channel having a bottom surface and a plurality of side surfaces having a coupling part formed therein and a side cover coupled to an open side of the channel, a plurality of light emitting devices disposed in the housing, each of the light emitting devices comprising a substrate and a plurality of LEDs mounted on the substrate, a plurality of diffusers detachably coupled to the coupling part, and an electronic module disposed between the light emitting devices to supply an electric power to the light emitting devices, wherein an introducing region is provided in the channel to insert and withdraw the diffusers therein and there through.

In one embodiment, a lighting apparatus may include a housing having a slide rail. The slide rail may have an opening formed thereon. A light emitting device may be provided, including a substrate arranged in the housing and a plurality of LEDs mounted on the substrate. A diffuser may be coupled to the slide rail, and may be configured to slide into and out of the housing via the opening. An electronic module may be arranged in the housing to supply electric power to the light emitting devices. A cover may be coupled to the housing to cover the opening of the slide rail and the electronic module.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus comprising:

a housing having a bottom surface, a first side surface that extends from the bottom surface and a second side surface that extends from the bottom surface and positioned to face the first side surface;

at least one substrate provided in the housing;

a plurality of LEDs mounted on the substrate;

at least one diffuser removably coupled to the housing and positioned over the at least one substrate; and an electronic module provided in the housing, wherein the housing includes a first channel formed on the first side surface of the housing, a second channel formed on the second side surface of the housing, the first and second channels having openings positioned to face each other to accommodate the diffuser, and an insertion slot formed at each of the first and second channels for slidably inserting the diffuser in the first and second channels, wherein the first and second channels include an outer surface and an inner surface that extend from the side surface of the housing substantially parallel to each other, wherein the outer surface is positioned adjacent to an outer surface of the diffuser and the inner surface is positioned adjacent to an inner surface of the diffuser, wherein the inner and outer surfaces of the channels are substantially parallel to the bottom surface of the housing, and the insertion slots are formed at a predetermined region of the outer surface of the first and second channels, the insertion slots being provided in a central region of the housing and face each other, and wherein the housing includes a side cover to enclose a longitudinal end of the housing, and wherein a slot is formed on the side cover and positioned to correspond to the first and second channels.

2. The lighting apparatus of claim 1, wherein the first and second channels extend along the housing in a longitudinal direction.

3. The lighting apparatus of claim 1, wherein the first and second channels protrude laterally from the first and second surfaces toward each other.

4. The lighting apparatus of claim 1, wherein the insertion slot is formed on the first and second channels to be parallel to the bottom surface of the housing.

5. The lighting apparatus of claim 1, wherein the insertion slot is formed on the first or second side surface of the housing and positioned to correspond to the first and second channels.

6. The lighting apparatus of claim 1, wherein the first and second channels are recesses formed on respective side surfaces of the housing.

7. The lighting apparatus of claim 1, wherein the electronic module is disposed in a central region of the housing to supply power to the LEDs.

8. The lighting apparatus of claim 7, wherein the at least one substrate is positioned adjacent to the electronic module, and the diffuser is positioned over the substrate.

9. The lighting apparatus of claim 1, wherein a coupling device is provided to couple the electronic module to the housing, the coupling device being formed to protrude a prescribed distance from the bottom surface of the housing such that a gap is formed between the electronic module and the bottom surface.

10. The lighting apparatus of claim 9, wherein a through-hole is provided at the bottom surface, and a cable for connecting the electronic module to an external electric power source is routed through the gap and the through-hole.

11. The lighting apparatus of claim 1, further including a cover removably coupled to the housing to cover the insertion slot and the electronic module and positioned between the diffusers.

12. The lighting apparatus of claim 11, wherein the cover includes a plurality of coupling ribs to removably couple the cover to the housing.

13. The lighting apparatus of claim 1, wherein the housing includes a guide rail formed on at least one of the first side surface or the second side surface of the housing and configured to slidably guide the substrate into the housing.

14. The lighting apparatus of claim 1, wherein the housing includes a plurality of flanges and a plurality of fastening holes formed on the flanges for mounting the housing.

15. The lighting apparatus of claim 14, wherein the plurality of the flanges extend from the bottom surface of the housing.

16. The lighting apparatus of claim 1, further including a reflector provided between the light emitting device and the diffuser, the reflector having a plurality of holes formed to correspond to a position of the plurality of the LEDs to expose the LEDs.

17. A lighting apparatus comprising:

a housing having a bottom surface, a first side surface that extends from the bottom surface and a second side surface that extends from the bottom surface and positioned opposite the first side surface;

at least one substrate provided in the housing;

a plurality of LEDs mounted on the substrate;

a diffuser removably coupled to the housing and positioned over the substrate; and an electronic module provided in the housing, wherein the housing includes a first channel formed on the first side surface of the housing and a second channel formed on the second surface of the housing, the first and second channels having openings positioned to face each other to accommodate the diffuser, wherein the first and second channels include an insertion slot formed on an outer surface of each of the channels such that the diffuser is slidably inserted in the first and second channels through the opening, wherein the first and second channels include an outer surface and an inner surface that extend from the side surface of the housing substantially parallel to each other, wherein the outer surface is positioned adjacent to an outer surface of the diffuser and the inner surface is positioned adjacent to an inner surface of the diffuser, wherein the inner and outer surfaces of the channels are substantially parallel to the bottom surface of the housing, and insertion slots are formed at a predetermined region of the outer surface of the first and second channels, the insertion slots being provided in a central region of the housing and face each other, and wherein the housing includes a side cover to enclose a longitudinal end of the housing, and wherein a slot is formed on the side cover and positioned to correspond to the first and second channels.

* * * * *